US005668513A

United States Patent [19]

Umezu

[11] Patent Number: 5,668,513

[45] Date of Patent: Sep. 16, 1997

[54] HERMETICALLY SEALED STRUCTURE FOR JUNCTION OF TWO WAVEGUIDES

[75] Inventor: Keiichi Umezu, Tokyo, Japan

[73] Assignee: NEC Corporation, Tokyo, Japan

[21] Appl. No.: 688,163

[22] Filed: Jul. 29, 1996

[30] Foreign Application Priority Data

Jul. 28, 1995 [JP] Japan ..... 7-192814

[51] Int. Cl.[6] ..... H01P 1/04; H01P 1/08

[52] U.S. Cl. ..... 333/252; 333/254

[58] Field of Search ..... 333/242, 252, 333/254, 255, 257

[56] References Cited

U.S. PATENT DOCUMENTS

| | | | |
|---|---|---|---|
| 2,930,008 | 3/1960 | Walsh | 333/252 |
| 3,860,891 | 1/1975 | Hiramatsu | 333/21 R |
| 4,041,420 | 8/1977 | Riblet | 333/252 X |
| 4,352,077 | 9/1982 | Gerlack | 333/252 |
| 4,786,883 | 11/1988 | Spinner | 333/254 X |
| 5,364,136 | 11/1994 | Forti et al. | 333/242 X |

FOREIGN PATENT DOCUMENTS

| | | |
|---|---|---|
| 1491484 | 10/1969 | Germany . |
| 837192 | 6/1960 | United Kingdom . |

*Primary Examiner*—Paul Gensler

*Attorney, Agent, or Firm*—Sughrue, Mion, Zinn, Macpeak & Seas

[57] ABSTRACT

A first circular waveguide or an elliptical waveguide has an inner circumferential surface tapered such that its inside dimension is gradually reduced continuously toward an end thereof. The elliptical waveguide comprises an antenna waveguide connected to an antenna device. Another circular waveguide has an end joined to the end of the first circular waveguide or the elliptical waveguide. Both waveguides have different inside dimensions at the joined ends. A hermetic seal is sandwiched between the joined ends of both the waveguides. The tapered inner circumferential surface is effective to cancel out a susceptance produced by the hermetic seal. The first waveguide with the tapered inner circumferential surface can easily be manufactured by die casting.

4 Claims, 2 Drawing Sheets

HERMETICALLY SEALED STRUCTURE FOR JUNCTION OF TWO WAVEGUIDES

BACKGROUND OF THE INVENTION

1. Field of the Invention

The present invention relates to a hermetically sealed structure for a junction of two waveguides, e.g., a feeder waveguide and an antenna waveguide, in a microwave circuit.

2. Description of the Prior Art

Conventional hermetically sealed structures for a junction of two circular waveguides will be described below with reference to FIGS. 1(*a*), 1(*b*) and 2(*a*), 2(*b*) of the accompanying drawings.

FIG. 1(*a*) and FIG. 2(*a*) are transverse cross-sectional views and FIG. 1(*b*) and FIG. 2(*b*) are fragmentary longitudinal cross sectional views.

FIGS. 1(*a*) and 1(*b*) show a conventional hermetically sealed structure for a junction of two circular waveguides. As shown in FIGS. 1(*a*) and 1(*b*), a circular waveguide 1 has an end coupled to an end of another circular waveguide 2 by a junction having a disk-shaped hermetic seal 3 sandwiched between the coupled ends of the circular waveguides 1, 2. The junction also includes an annular gasket 4 placed in an annular groove which is defined in the end of the circular waveguide 2, and hermetically held against the hermetic seal 3. The circular waveguide 1 may serve as an antenna waveguide connected to an antenna device, and the circular waveguide 2 as a feeder waveguide connected to a radio transmitter/receiver device.

In order to cancel out a susceptance produced by the hermetic seal 3 and achieve an impedance match at the junction, the circular waveguide 1 has a susceptance correction ring 5 projecting radially inwardly at the joined end thereof near the hermetic seal 3.

FIGS. 2(*a*) and 2(*b*) show another conventional hermetically sealed structure for use with a junction between two circular waveguides. Those parts shown in FIGS. 2(*a*) and 2(*b*) which are identical to those shown in FIGS. 1(*a*) and 1(*b*) are denoted by identical reference numerals. The conventional hermetically sealed structure shown in FIGS. 2(*a*) and 2(*b*) differs from the conventional hermetically sealed structure shown in FIGS. 1(*a*) and 1(*b*) in that susceptance correction screws 6 are mounted in suitable locations on an inner circumferential wall surface of the circular waveguide 1 near the hermetic seal 3.

The conventional hermetically sealed structure shown in FIGS. 1(*a*) and 1(*b*) is complex in structure and expensive to manufacture because of the susceptance correction ring 5 on the circular waveguide 1.

With the conventional hermetically sealed structure shown in FIGS. 2(*a*) and 2(*b*), it is necessary to insert and adjust the susceptance correction screws 6 after the circular waveguide 1 is assembled. If the circular waveguides 1, 2 are used outdoors, then the hermetically sealed structure needs to have a certain drip-resistant structure.

Furthermore, if the antenna coupled to the 10 circular waveguide 1 employs two-frequency cross polarization, then since corrective quantities for the respective polarization components are different from each other, the conventional hermetically sealed structures are more complex in structure.

SUMMARY OF THE INVENTION

It is an object of the present invention to provide a hermetically sealed structure of highly simple construction for a junction of two circular waveguides or a junction of an elliptical waveguide and a circular waveguide in which the mismatching of the impedance at the junction caused by the susceptance of the hermetic seal can be canceled.

According to the present invention, there is provided a hermetically sealed structure for a junction of two circular waveguides in which a hermetic seal is sandwiched between the ends of the two circular waveguides, comprising:

- a first circular waveguide having an inside diameter gradually reduced continuously toward an end thereof which is to be joined to an end of a second circular waveguide;
- a second circular waveguide having an end joined to the end of the first circular waveguide; and
- the first circular waveguide and the second circular waveguide having different inside diameters at the ends which are to be joined through the hermetic seal.

One of the first and second circular waveguides may comprise an antenna waveguide connected to an antenna device, and the other of the first and second circular waveguides may comprise a feeder waveguide connected to a radio transmitter/receiver device.

There is provided another hermetically sealed structure for a junction of an elliptical waveguide and a circular waveguide in which a hermetic seal is sandwiched between the ends of the elliptical waveguide and the circular waveguide, comprising:

- an elliptical waveguide having an inside dimension gradually reduced continuously, keeping the similarity of the shapes, toward an end thereof which is to be joined to an end of a circular waveguide;
- a circular waveguide having an end joined to the end of the elliptical waveguide; and
- the elliptical waveguide and the circular waveguide having different inside dimensions at the ends which are to be joined through the hermetic seal.

The elliptical waveguide may comprise an antenna waveguide connected to an antenna device, and the circular waveguide may comprise a feeder waveguide connected to a radio transmitter/receiver device.

Both the first circular waveguide and the elliptical waveguide have a tapered inner circumferential surface such that its inside dimension is gradually reduced continuously toward the end thereof. The tapered inner circumferential surface is effective to cancel out a susceptance produced by the hermetic seal.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 1(*b*) is a fragmentary longitudinal cross-sectional view of the conventional hermetically sealed structure shown in FIG. 1(*a*);

FIG. 2(*b*) is a fragmentary longitudinal cross-sectional view of the conventional hermetically sealed structure shown in FIG. 2(*a*);

FIG. 3(*b*) is a fragmentary longitudinal cross-sectional view of the hermetically sealed structure shown in FIG. 3(*a*);

FIG. 4(*b*) is a fragmentary longitudinal cross-sectional view of the hermetically sealed structure shown in FIG. 4(*a*).

DESCRIPTION OF THE PREFERRED EMBODIMENTS

Figure 1A:
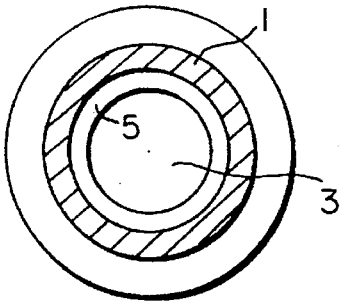
FIG. 1(a) PRIOR ART
FIG. 1(*a*) is a transverse cross-sectional view of a conventional hermetically sealed structure for a junction between two circular waveguides, the view being taken along line A—A of FIG. 1(*b*)
Figure 1B:
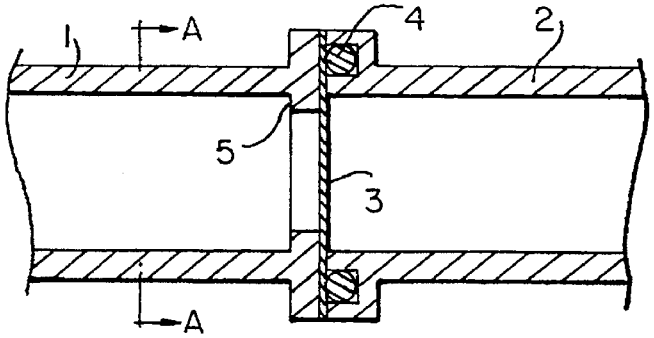
FIG. 1(b) PRIOR ART
Figure 2A:
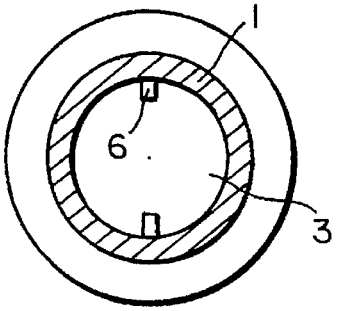
FIG. 2(a) PRIOR ART
FIG. 2(*a*) is a transverse cross-sectional view of another conventional hermetically sealed structure for a junction between two circular waveguides, the view being taken along line A—A of FIG. 2(*b*)
Figure 2B:
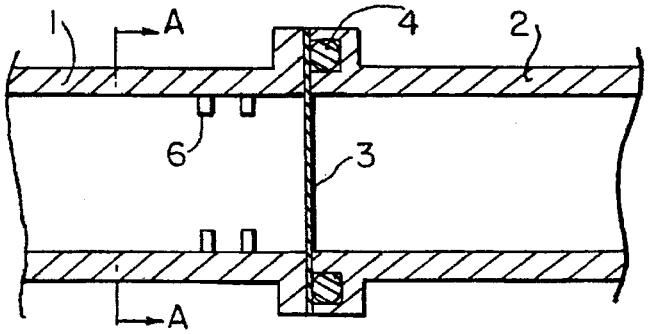
FIG. 2(b) PRIOR ART
Figure 3A:
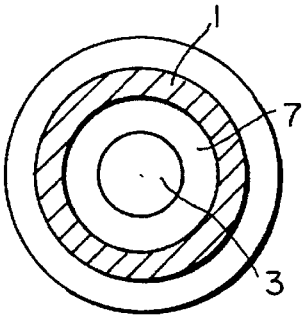
FIG. 3(*a*) is a transverse cross-sectional view of a hermetically sealed structure for a junction between two circular waveguides according to an embodiment of the present invention, the view being taken along line A—A of FIG. 3(*b*)
Figure 3B:
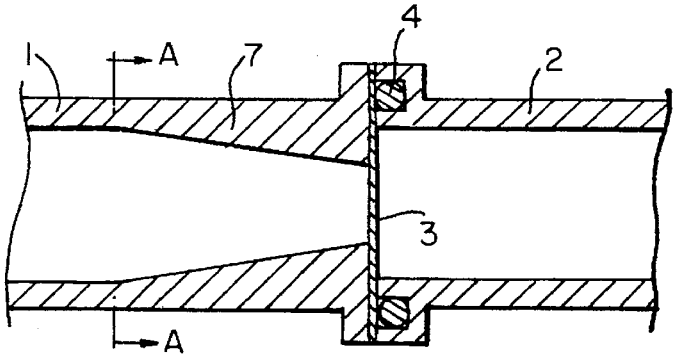

FIGS. 3(*a*) and 3(*b*) show a hermetically sealed structure for a junction of two circular waveguides according to an embodiment of the present invention. As shown in FIGS. 3(*a*) and 3(*b*), a circular waveguide 1 has an end coupled to an end of another circular waveguide 2 by a junction having a disk-shaped hermetic seal 3 sandwiched between the coupled ends of the circular waveguides 1, 2. The junction also includes an annular gasket 4 placed in an annular groove which is defined in the end of the circular waveguide 2, and hermetically held against the hermetic seal 3. The circular waveguide 1 serves as an antenna waveguide connected to an antenna device, and the circular waveguide 2 as a feeder waveguide connected to a radio transmitter/receiver device.

The circular waveguide 1 has an inner circumferential wall surface 7 tapered axially such that its inside diameter is gradually reduced continuously in the axial direction toward the junction. At the junction, the inside diameter of the circular waveguide 1 is smaller than the inside diameter of the circular waveguide 2. The difference between the inside diameters of the circular waveguides 1, 2 is selected to cancel out a susceptance produced by the hermetic seal 3. Therefore, the tapered inner circumferential wall surface 7 of the circular waveguide 1 serves as a susceptance corrector.

Figure 4A:
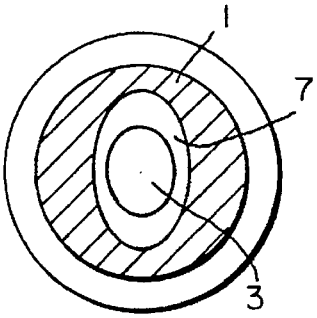
FIG. 4(*a*) is a transverse cross-sectional view of a hermetically sealed structure for a junction between an elliptical waveguide and a circular waveguide according to another embodiment of the present invention, the view being taken along line A—A of FIG. 4(*b*)
Figure 4B:
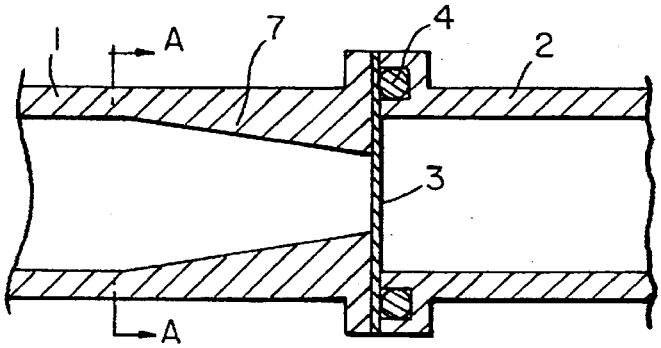

FIGS. 4(*a*) and 4(*b*) show a hermetically sealed structure for a junction of an elliptical waveguide and a circular waveguide according to another embodiment of the present invention. In this case the waveguide 1 has an elliptical inside shape and the waveguide 2 has a circular inside shape in the transverse cross section. Accordingly, the hermetically sealed structure shown in FIGS. 4(*a*) and 4(*b*) differs from the hermetically sealed structure shown in FIGS. 3(*a*) and 3(*b*) only in that the tapered inner circumferential wall surface 7 of the waveguide 1 provides an elliptical opening at the junction as shown in FIG. 4(*a*).

As shown in FIGS. 3(*a*), 3(*b*) and 4(*a*), 4(*b*), the circular or elliptical waveguide 1 has different input and output end shapes due to the tapered inner circumferential wall surface 7 thereof, and the dimension of the circle or ellipse of the circular waveguides 1, 2 are different from each other at the hermetic seal 3, making it possible to compensate for the susceptance produced by the hermetic seal 3.

Since the inner circumferential wall surface 7 is tapered axially with the dimensions of the waveguides being gradually reduced continuously in the axial direction toward the junction, the circular or elliptical waveguide 1 lends itself to being manufactured by die casting, and hence can be manufactured very inexpensively irrespective of whether the waveguide 1 has a circular inner section or an elliptical inner section.

With the arrangement of the embodiments above, the different input and output end shapes of the circular or elliptical waveguide 1 which are generated by the tapered inner circumferential wall surface 7 thereof are utilized to compensate for the susceptance produced by the hermetic seal 3. Therefore, no extra members such as a ring or screws are added for susceptance correction or impedance matching. The hermetically sealed structures according to the present invention are thus simple in construction and inexpensive to manufacture.

In the case when the antenna coupled to the elliptical waveguide employs two-frequency cross polarization, the hermetically sealed structure for a junction of an elliptical waveguide and a circular waveguide can be greatly simplified by adopting the embodiment shown in FIGS. 4(*a*) and 4(*b*).

Although certain preferred embodiments of the present invention have been shown and described in detail, it should be understood that various changes and modifications may be made therein without departing from the scope of the appended claims.

What is claimed is:

1. A hermetically sealed structure for a junction of two circular waveguides, in which a hermetic seal is sandwiched between the ends of said two circular waveguides, comprising:

a first circular waveguide having an inside diameter gradually reduced continuously toward an end thereof which is to be joined to an end of a second circular waveguide;

a second circular waveguide having an end joined to said end of said first circular waveguide; and said first circular waveguide and said second circular waveguide having different inside diameters at the ends which are to be joined through said hermetic seal.

2. A hermetically sealed structure according to claim 1, wherein one of the first and second circular waveguides comprises an antenna waveguide connected to an antenna device, and the other of the first and second circular waveguides comprises a feeder waveguide connected to a radio transmitter/receiver device.

3. A hermetically sealed structure for a junction of an elliptical waveguide and a circular waveguide, in which a hermetic seal is sandwiched between the ends of said elliptical waveguide and said circular waveguide, comprising:

an elliptical waveguide having an inside dimension gradually reduced continuously, keeping the similarity of the shapes, toward an end thereof which is to be joined to an end of a circular waveguide;

a circular waveguide having an end joined to said end of said elliptical waveguide; and said elliptical waveguide and said circular waveguide having different inside dimensions at the ends which are to be joined through said hermetic seal.

4. A hermetically sealed structure according to claim 3, wherein said elliptical waveguide comprises an antenna waveguide connected to an antenna device, and said circular waveguide comprises a feeder waveguide connected to a radio transmitter/receiver device.

* * * * *